US005190635A

United States Patent [19]

Hettinger

[11] Patent Number: 5,190,635

[45] Date of Patent: Mar. 2, 1993

[54] SUPERPARAMAGNETIC FORMATION OF FCC CATALYST PROVIDES MEANS OF SEPARATION OF OLD EQUILIBRIUM FLUID CRACKING CATALYST

[75] Inventor: William P. Hettinger, Russell, Ky.

[73] Assignee: Ashland Oil, Inc., Ashland, Ky.

[21] Appl. No.: 777,473

[22] Filed: Oct. 17, 1991

Related U.S. Application Data

[63] Continuation of Ser. No. 601,965, Oct. 18, 1990, abandoned, which is a continuation-in-part of Ser. No. 332,079, Apr. 3, 1989, abandoned.

[51] Int. Cl.[5] ..... C10G 11/18

[52] U.S. Cl. ..... 208/113; 208/120; 208/118

[58] Field of Search ..... 208/113, 120, 118; 502/15, 21; 209/8, 636

[56] References Cited

U.S. PATENT DOCUMENTS

| | | | |
|---|---|---|---|
| 1,390,688 | 9/1921 | Ellis . | |
| 1,576,690 | 3/1926 | Ullrich . | |
| 2,065,460 | 12/1936 | Johnson | 209/214 |
| 2,264,756 | 12/1941 | Johnston | 260/81 |
| 2,348,418 | 5/1944 | Roesch | 196/52 |
| 2,459,343 | 1/1949 | Schuner | 210/1.5 |
| 2,471,078 | 5/1949 | Ogorzaly | 196/52 |
| 2,604,207 | 7/1952 | Scott | 209/218 |
| 2,631,124 | 3/1953 | Ogorzaly | 196/52 |
| 2,635,749 | 4/1953 | Cropper | 209/127 |
| 2,723,997 | 11/1955 | Reynolds | 260/604 |
| 3,010,915 | 11/1961 | Buell | 252/459 |
| 3,463,310 | 8/1969 | Ergun | 209/8 |
| 3,531,413 | 9/1970 | Rosenweig | 252/62.62 |
| 3,725,241 | 4/1973 | Chervenak | 208/10 |
| 3,901,795 | 8/1975 | Smith | 209/39 |
| 3,917,538 | 11/1975 | Rosenweig | 252/62.51 |
| 3,926,789 | 12/1975 | Shubert | 209/8 |
| 4,021,367 | 5/1977 | Gal | 252/411 |
| 4,029,495 | 6/1977 | Hirayama | 75/10 |
| 4,280,896 | 7/1981 | Bearden | 208/113 |
| 4,292,171 | 9/1981 | Mayer | 208/164 |
| 4,294,688 | 10/1981 | Mayer | 208/164 |
| 4,299,687 | 11/1981 | Myers | 208/113 |
| 4,332,673 | 6/1982 | Myers | 208/120 |
| 4,341,624 | 7/1982 | Myers | 208/120 |
| 4,347,122 | 8/1982 | Myers | 208/113 |
| 4,354,923 | 10/1982 | Myers | 208/113 |
| 4,359,379 | 11/1982 | Ushio | 208/120 |
| 4,360,441 | 11/1982 | Barrelli | 252/62.59 |

(List continued on next page.)

OTHER PUBLICATIONS

"Magnetic Methods for the Treatment of Materials" by J. Svovada (pub. by Elsevier Science Pub. Co. Inc., N.Y. (ISBNO-44-42811-9) vol. 8.

"Fluid Dynamics and Science of Magnetic Liquids", R. E. Rosensweig, Advance in Electronics and Electron Physics, vol. 48 (1979) pp. 103-199, Academic Press.

cf. C. P. Bean and J. D. Livingston, Superparamagnetism, J. Appl. Phys., Suppliment to vol. 30, No. 4, pp. 1205-1295, 1959.

Weast, "Handbook of Chemistry and Physics", 57th Edition (1976-1977), p. E120 (lower table).

*Primary Examiner*—Akok Pal

*Attorney, Agent, or Firm*—Richard C. Willson, Jr.

[57] ABSTRACT

Improved catalytic process for carrying out heavy hydrocarbon conversion in the presence of metal on the catalyst and in the feedstock, by catalytic cracking such heavy carbometallic oils to lighter molecular weight fractions. The discovery of a ferro/superparamagnetic component of older catalyst, which when present, can be employed to achieve enhanced magnetic separation of aged catalyst. This invention utilizes this property to enhance separation of more magnetically active, older, less catalytically active and selective, higher metals-containing catalyst particulates from less magnetically active, lower metal containing particulates. The more catalytically active and selective catalysts fractions, are then recycled back to the process.

16 Claims, 11 Drawing Sheets

U.S. PATENT DOCUMENTS

| | | | |
|---|---|---|---|
| 4,388,179 | 6/1983 | Lewis | 208/177 |
| 4,390,415 | 6/1983 | Myers | 208/113 |
| 4,394,282 | 7/1983 | Seiver | 252/62.55 |
| 4,406,773 | 9/1983 | Hettinger | 208/120 |
| 4,419,223 | 12/1983 | Myers | 208/120 |
| 4,444,651 | 4/1984 | Myers | 208/120 |
| 4,482,450 | 11/1984 | Ushio | 208/152 |
| 4,541,920 | 9/1985 | Seiver | 208/138 |
| 4,602,993 | 7/1986 | Myers | 208/113 |
| 4,695,392 | 9/1987 | Whitehead | 252/62.54 |
| 4,702,825 | 10/1987 | Salvaggi | 209/224 |
| 4,708,785 | 11/1987 | Myers | 208/113 |
| 4,772,381 | 9/1988 | Julius | 209/12 |
| 4,777,031 | 10/1988 | Senecal | 423/632 |
| 4,810,401 | 3/1989 | Mair | 252/62.56 |
| 4,824,587 | 4/1989 | Kwon | 252/62.55 |
| 4,827,945 | 5/1989 | Groman | 128/653 |
| 4,839,593 | 6/1989 | Spies | 324/240 |
| 4,878,132 | 10/1989 | Aratani | 360/59 |

SUPERPARAMAGNETIC FORMATION OF FCC CATALYST PROVIDES MEANS OF SEPARATION OF OLD EQUILIBRIUM FLUID CRACKING CATALYST

CROSS REFERENCE TO RELATED APPLICATIONS

This application is a continuation application of U.S. Ser. No. 601,965 filed Oct. 18, 1990, now abandoned, which is a continuation-in-part of co-pending U.S. patent application Ser. No. 332,079, filed Apr. 3, 1989 now abandoned.

Cross references to related application:

U.S. patent application Ser. No. 479,003, filed Feb. 9, 1990, now U.S. Pat. No. 5,106,486, relates to the general field of the present invention.

U.S. Pat. No. 4,406,773 (1983) of W. P. Hettinger, Jr., et al discloses use of high magnetic field gradients produced from SALA-HGMS (high-intensity, high gradient magnetic separators). A carrousel magnetic separator containing a filamentary matrix within produces a high magnetic field gradient to achieve selective separation.

RERMS

Subsequent work has developed a preferred method of separation involving the use of a magnetic rare earth roller device (RERMS) and a pending application U.S. Ser. No. 07/332,079 filed Apr. 3, 1989, abandoned, covers the concept of using such a device for magnetic separation.

In attempting to further improve separation, it has now been discovered that in the presence of larger amounts of paramagnetic iron, further improvement in separation selectivity can be realized and a pending application U.S. Ser. No. 07/479,003 filed Feb. 9, 1990 now U.S. Pat. No. 5,106,486, covers the concept of a "Magnetic Hook" TM, and the use of continuous addition of iron to enhance separation.

BACKGROUND OF INVENTION

I. Field of the Invention

The present invention relates to separation of hydrocarbon and other catalysts and sorbents by magnetic separation, generally classified in Class 55; Subclass 3; and Class 120, Subclasses 119+ of the U.S. Patent and Trademark Office.

In fluid bed cracking of hydrocarbon feedstocks, it is the practice, because of the rapid loss in catalyst activity and selectivity, to continuously add fresh catalyst regularly, usually daily, to an equilibrium mixture of catalyst particles. These small microspherical particles vary in size from 10 to 150 microns and represent a highly dispersed mixture of catalyst particles. Some have been present in the unit for as little as one day, while others have been there for as long as 60–90 days or more. Because these particles are so small, no process has been available to remove old catalysts from new, therefore, it usually is customary to withdraw 1 to 10% or more of equilibrium catalyst which contains all of these variously aged particles just prior to addition of fresh catalyst particles, thus providing room for the incoming fresh material. Unfortunately, the 1 to 10% of equilibrium catalyst withdrawn contains 1–10% of the very expensive catalyst added the day before, 1–10% of the catalyst added 2 days ago, 1–10% of the catalyst added 3 days ago, and so forth. Therefore unfortunately, a large proportion of withdrawn catalyst represents still very active catalyst.

Consumption of particulate (which in preferred cases is cracking catalyst) can be very high. The cost associated therewith, especially when high nickel and vanadium are present in amounts greater than 0.1 ppm in the feedstock can, therefore, be very great. Depending on the level of metal content in feed and desired catalyst activity, tons of catalyst must be added daily. For example, the cost of a catalyst at the point of introduction to the unit can rise as high as $2,000/ton. As a result, a unit consuming 20 tons/day of catalyst would require expenditures each day of at least $40,000. For a unit processing 40,000 barrels per day this would represent a processing cost of $1/barrel or 2.5 cents/gallon, for catalyst use alone.

In addition to catalyst costs, an aged and highly nickel and vanadium laden catalyst can also bring about a reduction in yield of valuable and preferred liquid fuel products, such as gasoline and diesel fuel, and instead, produce more undesirable, less valuable products, such as dry gas and coke. A high level of nickel and vanadium on catalyst can also accelerate catalyst deactivation, thus further reducing operating profits.

Because of this required daily addition of catalyst (or sorbent) particulates, there results immediate and complete mixing of these microspherical particulates both fresh in performance and low in contaminants (usually nickel, vanadium, iron, copper, and sodium) with other microspherical particulates high in these adverse elements and very low in activity and which particulates have been in the unit for varying times as long as 60–90 days or longer. These older catalysts have drastically dropped in performance while simultaneously accumulating these aforementioned deleterious metal contaminants which catalytically greatly accelerate production of hydrogen and coke as well as dry gas.

As a result, industry has long felt a need to have a means by which the older (earlier added) catalyst can be selectively removed without inclusion or entrainment of the newer (freshly added) catalyst in order to reduce catalyst addition rates while at the same time maintaining better activity, selectivity and unit performance. Because of the very small size of these particles, billions of particles are involved, and mechanical separation has not been feasible even if one could rapidly identify by some means, as for example, color, which particles are old, and which are new.

II. Description of the Prior Art

"Magnetic Methods For The Treatment of Materials" by J. Svovoda published by Elsevier Science Publishing Company, Inc., New York (ISBNO-44-42811-9) Volume 8) discloses both theoretical equations describing separation by means of magnetic forces with the corresponding types of equipment that may be so employed. Specific reference at pages 135–137 is made to cross-belt magnetic separators and pages 144–149 refer to belt magnetic separators involving a permanent magnet roll separator, as well as pages 161–197 which refer to high gradient magnetic separators, all of which are efficient in separating magnetic particles.

A manual search in the U.S. Patent Office, Class 55, subclass 3; Class 208, subclasses 52CT, 113, 119, 120, 121, 124, 137, 139, 140, 152, 251R, and 253; Class 209, subclasses 8, 38, 39, and 40; and Class 502, subclasses 5, 20, 21, 38, 515, 516, and 518 found principally the following references:

PATENTS RELATED TO HYDROCARBON PROCESSING

U.S. Pat. No. 4,359,379 and 4,482,450 to Ushio (assigned Nippon Oil Company), both disclose catalytic cracking and hydrotreating processes for carbo-metallic feedstocks by depositing (adding) nickel, vanadium, iron, and/or copper (originally contained in the heavy oil), and then separating the old catalyst utilizing a high gradient magnetic separator (HGMS). The magnetizement is derived from the metals contained in the starting oil.

U.S. Pat. No. 2,348,418 (col. 2) to Roesch (Standard Oil, Indiana) regenerates catalyst by adding a magnetic substance, such as iron or nickel to the catalyst before the catalyst is introduced into a magnetic separator.

PROCESSES AND APPARATUS FOR MAGNETIC SEPARATION

U.S. Pat. No. 1,390,688 (1921) to Ellis discloses magnetic separation of catalytic material by means of an electromagnetic or permanent magnet, wherein finely divided nickel or magnetizable nickel oxide are removed from fatty acid oils prior to filtration of the fatty acid oils. The oil and suspended catalyst are allowed to flow past a plate under which electromagnets are placed, causing the suspended catalyst to collect in a spongy mass around the magnetic poles and allowing the oil to pass off in the state of substantial clarity.

U.S. Pat. No. 3,010,915 (1961) to Buell discloses a process involving nickel on kieselguhr catalyst for recycle of magnetically separated magnetic catalyst back to be used for further reactions. The catalyst size is from 1 to 8 microns. The specific nature of the magnetic separator is not considered the critical feature of the invention.

PATENTS RELATED TO SUPERPARAMAGNETISM AND FERRO/FERROMAGNETISM

U.S. Pat. No. 4,695,392 (1987) to Whitehead produces magnetic particles for use in separations by precipitation of superparamagnetic iron oxide. The precipitate is washed repeatedly with water by magnetically separating it and redispersing it until a neutral pH is reached. The precipitate is then washed once in an electrolytic solution, e.g. a sodium chloride solution. The electrolyte wash step is important to insure fineness of the iron oxide crystals. Finally the precipitate is washed with methanol until a residue of 1.0% (V/V) water is left.

Repeated use of magnetic fields to separate the iron oxide from suspension during the washing steps is facilitated by superparamagnetism. Regardless of how many times the superparamagnetic particles are subjected to magnetic fields, they never become permanently magnetized and consequently can be redispersed by mild agitation. Permanently magnetized (ferromagnetic) metal oxides cannot be prepared by this washing procedure as they tend to magnetically aggregate after exposure to magnetic fields and cannot be homogeneously redispersed.

U.S. Pat. No. 4,824,587 Apr. 25, 1989) to Kwon. Composites of coercive particles which retain residual magnetism when the magnetic field is removed, and superparamagnetic particles consisting of a coercive particulate material which can be maintained within the solid matrix, and a superparamagnetic particulate material. In the preferred composites, the superparamagnetic particulate materials are dispersed in the solid matrix in such a way that the composite behaves as if the superparamagnetic particles encapsulate the coercive particles.

Coercive particles useful in this invention are any magnetic particles which are of a size greater than that at which superparamagnetism is exhibited. Preferably, the coercive particles are of a size within a range such that said particles exhibit a coercivity great enough to exhibit interaction effects when combined with the superparamagnetic particles. The coercivity of such particles can depend upon factors such as the shape, size and composition of the particles. Most preferably, such particles are of a size very nearly equal to, or equal to, the single domain stage.

Ferrofluids are colloidal aqueous dispersions of finely divided magnetic particles of subdomain size, i.e. from about 20 to 200 A, and are characterized by resistance to settling in the presence of gravitational or magnetic force fields and resistance for change of its liquid properties in the presence of an applied magnetic field. Ferrofluids also display superparamagnetism. The preparation and properties of ferrofluid compositions are described in U.S. Pat. Nos. 3,531,413 and 3,917,538 which are incorporated herein by reference. Preparation of ferrofluids and the laws and relationships that govern their behavior are treated in "Fluid Dynamics" and Science of Magnetic Liquids", R. E. Rosensweig, Advances in Electronics and Electron Physics, Vol. 48 (1979), pp. 103–199, Academic Press.

SUMMARY OF THE INVENTION

I. General Statement of the Invention

This invention embodies the discovery that at higher levels of iron, unusual ferro/superparamagnetic properties never previously reported, to out knowledge, form in certain aged cracking catalyst, apparently under little understood, but unusual conditions of metal deposition and severe operating and regeneration conditions. Because of these extemely strong magnetic properties, it has now been determined that when these properties are present, substantial improvement in magnetic separation of old, low-activity, high metals containing catalysts from fresh, high activity, low-metals catalysts, can be achieved.

The term "superparamagnetism" is defined as that magnetic behavior exhibited by iron oxides with crystal size less than about 300 Angstrom, which behavior is characterized by responsiveness to a magnetic field without resultant permanent magnetization. That is, there is little or no hysterysis or residual magnetism when the field is removed.

Superparmagnetism is understood as meaning the ideal magnetically soft behavior of a ferromagnetic or paramagnetic solid particle. Such behavior is exhibited when the magnetic energy $K \times V$ of a solid particle ($K$=anisotropy constant, $V$=particle volume) decreases continuously and at some point reaches the order of magnitude of the thermal energy $k \times T$ ($k$=Boltzmann constant, $T$=absolute temperature in Kelvin), so that there is no longer any permanent dipole. For cubic ferrites (the solid particles I according to the invention belong to this class of compounds), the critical maximum particle diameter from which this behavior is exhibited is about 5–15 nm (cf. C. P. Bean and J. D. Livingston, Superparamagnetism, J. Appl.

Phys., Supplement to Volume 30, No. 4, pages 120S–129S, 1959). In the case of the cubic ferrites, assuming that they are present as monodisperse, substantially pore-free spherical particles, this critical particle diameter roughly corresponds to a BET surface area of from 40 to 130 m<2>/g, determined according to Brunauer, Emmet and Teller (cf. R. Brdicka, Grundlagen der Physikalischen.

The term "ferromagnetism" is defined as that magnetic behavior exhibited by iron oxides with crystal size greater than about 500 Angstrom, which behavior is characterized by responsiveness to a magnetic field with resultant permanent magnetism. "Ferromagnetism" is the similar behavior exhibited by iron (element), and is often additionally present in superparamagnetic materials. Thus, "superparamagnetism" as used herein includes ferromagnetic/superparamagnetic" materials.

Paramagnetic properties are those reported in the *Handbook of Chemistry and Physics*, pages E122–E127, Vol. 57, 1976–77, CRC Press, and as measured in a Johnson-Mathey Balance.

Like paramagnetic materials, superparamagnetic materials are characterized by an inability to remain magnetic in the absence of an applied magnetic field. Superparamagnetic materials can have magnetic susceptibilities nearly as high as ferromagnetic materials and far higher than paramagnetic materials.

Ferromagnetism and superparamagnetism are properties of lattices rather than ions or gases. Iron oxides such as magnetite and gamma ferric oxide exhibit ferromagnetism or superparamagnetism depending on the size of the crystals comprising the material, with larger crystals being ferromagnetic.

As generally used, superparamagnetic and ferromagnetic materials alter the nuclear magnetic resonance (MR) image by decreasing T2 resulting in image darkening. When injected, crystals of these magnetic materials accumulate in the targeted organs or tissues and darken the organs or tissues where they have accumulated.

Normally, contaminating metals such as nickel and iron when present on equilibrium catalyst, are present as paramagnetic species, as previously determined by measurement of magnetic susceptibility properties on a "Faraday balance" described in J. Svaboda. These elements (or ions of these elements) exhibit small but finite and useful paramagnetic susceptibilities which allow or facilitate magnetic separation of particles containing greater amounts of metal from those containing lesser amounts of metal. However, it is apparent that much better separation of old from fresh catalyst could be achieved if these metal contaminants could somehow be given much higher magnetic properties.

In particular, it now appears that this rare superparamagnetism which has just been discovered in catalysts, is strongly associated with easier and improved separation. While this unusual specie has not been fully identified chemically, nor determined as to how it forms, its presence can be detected by this display of high magnetic susceptibility properties as measured on a Johnson-Mathey Magnetic Susceptibility Balance, and does appear to be associated with the presence of higher iron concentrations. It may possibly also be related to nickel content, and perhaps even to rare earths and zeolites, present in today's cracking catalysts.

Its presence can be observed by measurement of magnetic susceptibility of equilibrium catalyst on a Johnson-Mathey Magnetic Susceptibility Balance, and more preferably, by magnetic susceptibility balance measurement of magnetic fractions obtained by means of multistep magnetic separation and most preferably by comparing these values with metal content on the catalyst. When magnetic susceptibility rises significantly above values predicted based on content of paramagnetic iron and nickel, superparamagnetism is indicated.

These measurements of magnetic susceptibility (Xg) have been made on a Johnson-Mathey Magnetic Susceptibility Balance, manufactured by Sherwood Scientific, Limited of Cambridge, England, and sold by Johnson-Mathey Corporation of Wayne, Pennsylvania. This device resulted from a Johnson Mathey collaboration with Professor D. F. Evans of Imperial College, London, England, who is a noted authority on paramagnetism. (See Johnson-Mathey brochure 89-460, 1990.

It is not yet clear when and how these superparamagnetic species form, and this invention is not to be limited to any explanation of this phenomenon or to any theory. It is, however, possible to some extent, to describe its unique properties.

Originally, this strong magnetic property was considered to be evidence for the presence of only a ferromagnetic specie. However, during his magnetic investigation of catalysts submitted by the present inventor by means of a spinning sample magnetometer by Professor L. N. Mulay of Penn State University, a noted authority on magneto chemistry, only very slight magnetic anisotropy was reported. (Magnetic anisotropy is an identifying characteristic of ferromagnetic substances.) He also has noted that these specimens containing high magnetic susceptibility values also appear to possess superparamagnetic behavior. Therefore, he has suggested that we identify our unknown as a ferro/superparamagnetic composite.

Apparently the ferro/superparamagnetic phenomenon that we have observed, and as described by Mulay, is displayed by very small magnetic particles, many probably less than 200 Angstrom in size, which very likely consist of single, or small coupling of several, and possibly, partially oriented domains. He has suggested that if these domains are combined with others, they should also very likely have ferromagnetic properties, as he has observed. When these domains are clustered in groups of two or more, they may interact and thus create the magnetic anisotropy associated with ferromagnetism.

But single domains, unable to interact with other domains, do not display this anisotropy. They are, therefore, described as superparamagnetic species, because they have these magnetic properties many-fold as strong as an equivalent number of paramagnetic ions or elements. A test of superparamagnetism reportedly can be made by plotting magnetic susceptibility as observed, divided by magnetic susceptibility at saturation versus field strength (H) in Oersteds divided by absolute temperature in degrees Kelvin. Also, superparamagnetism is indicated by intense Nuclear Magnetic Resonance (NMR) signal. Paramagnetism on the other hand does not reach saturation as the magnetic field strength increases, and a plot of magnetic susceptibility versus field strength, shows a continuing straight line increase. (See FIG. 1.)

BRIEF DESCRIPTION OF THE DRAWINGS

In FIG. 4, it is apparent that when only the 4500 ppm of iron found in the virgin catalyst is present, magnetic properties are very low and agree with reported paramagnetic iron values, and that much lower magnetic susceptibility results. (Note the lowest open-circle in FIG. 4).

However, as iron from the feedstock starts to accumulate on the catalyst as a function of age, magnetic susceptibility rises extremely rapidly. (This rise is closely similar to that observed when virgin catalyst is artificially blended with synthetic magnetite, a mineral of historical significance as related to the discovery of the compass.) This comparison is discussed in Example 2.

Figure 5B:
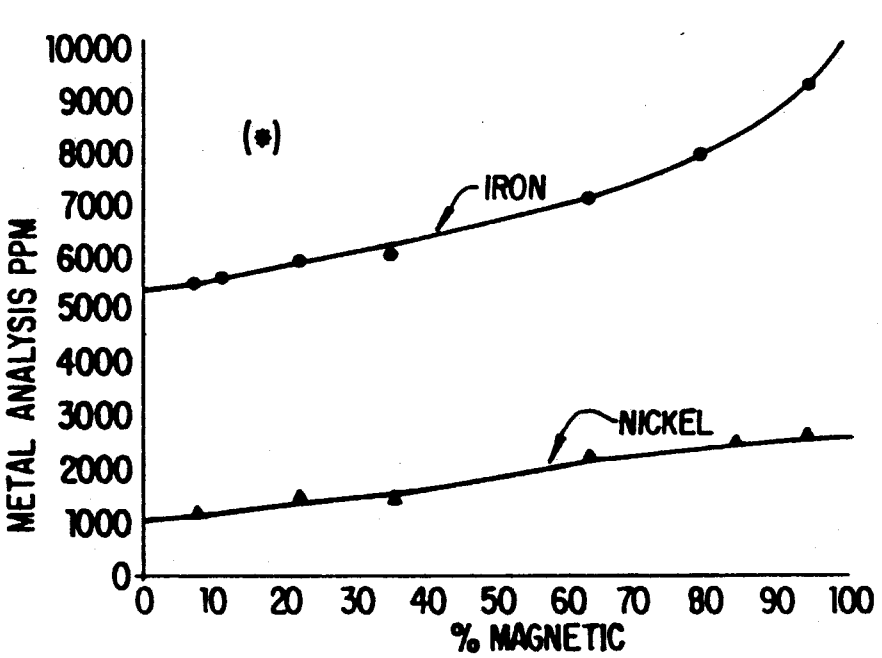
Figure 5A:
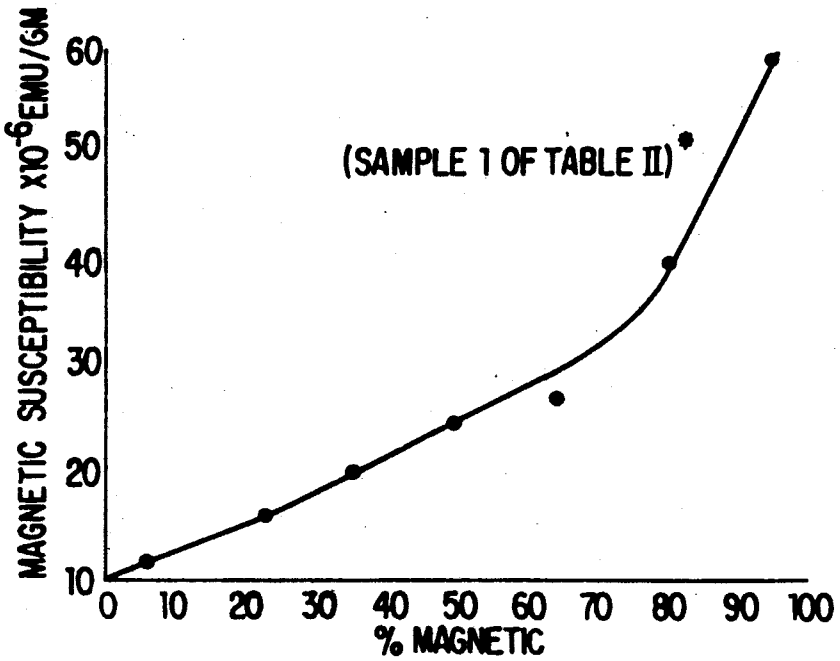
Figure 11:
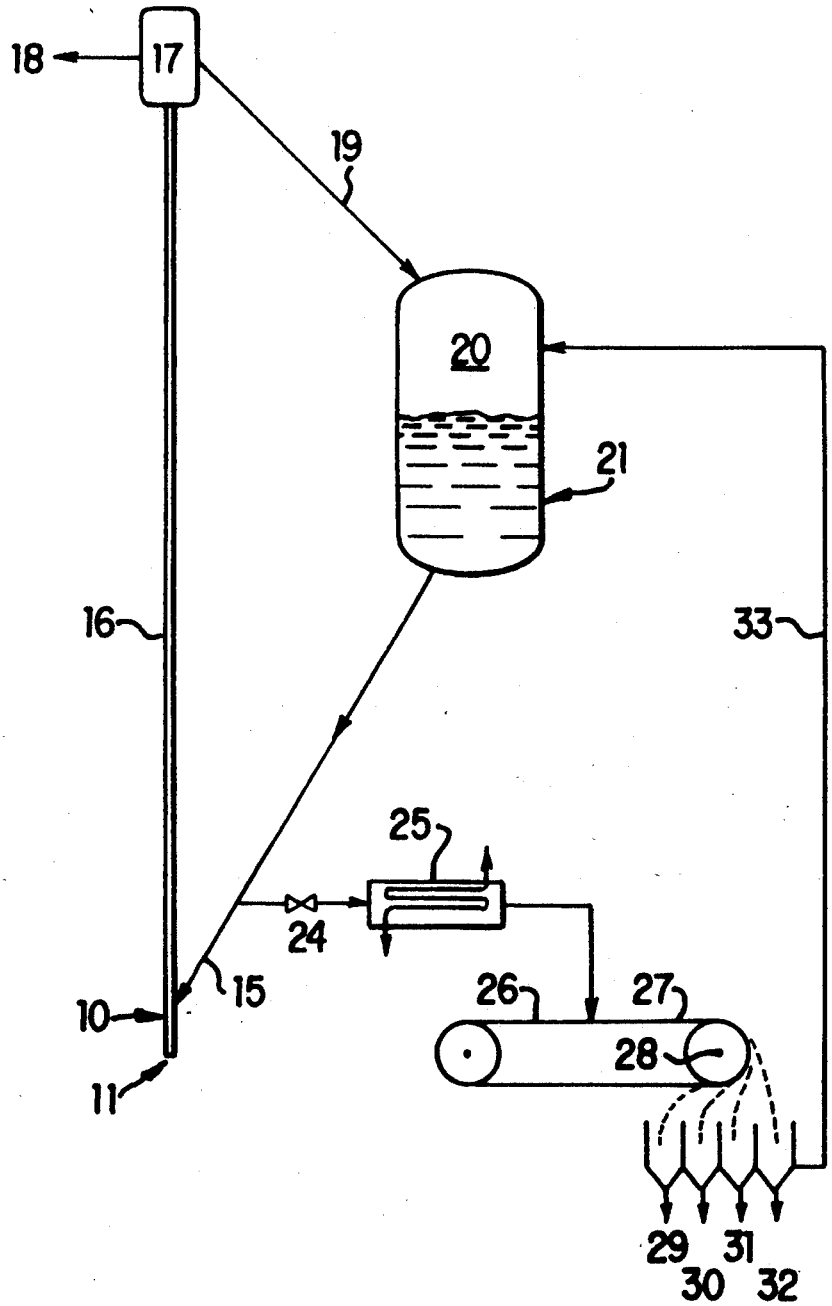

FIG. 5A is a plot of magnetic susceptibility ($10^{-6}$ emu/gm) versus percent magnetic for a number of fractions of different average magnetic susceptibility taken from sample 1 of Table III, and separated by a rare earth roller magnetic separation device as shown in FIG. 11.

Figure 6B:
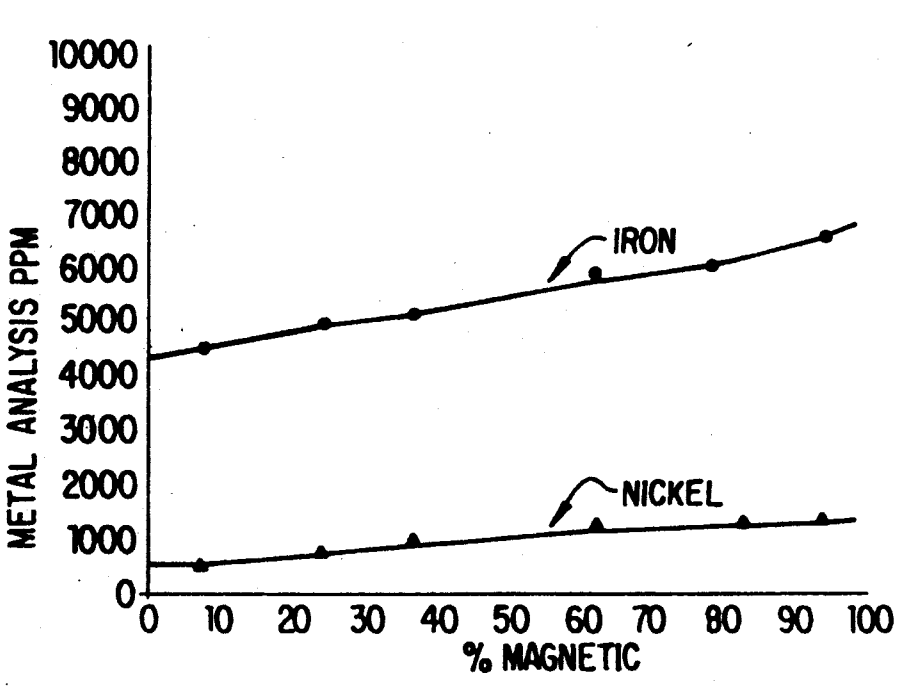
Figure 6A:
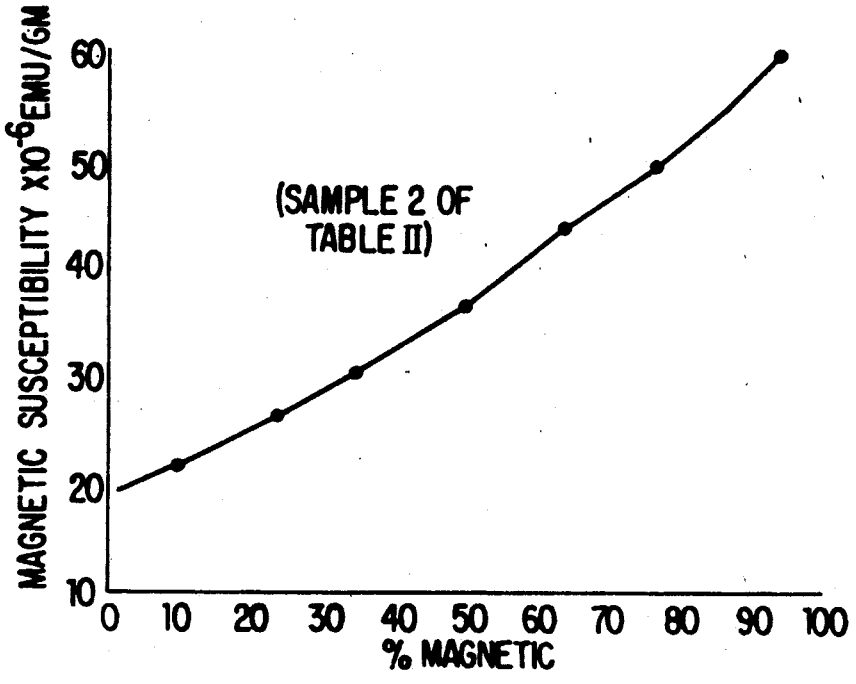

FIG. 6A is a similar plot of magnetic susceptibility ($10^{-6}$ emu/gm) versus percent magnetic for sample 2 of Table III.

Figure 7A:
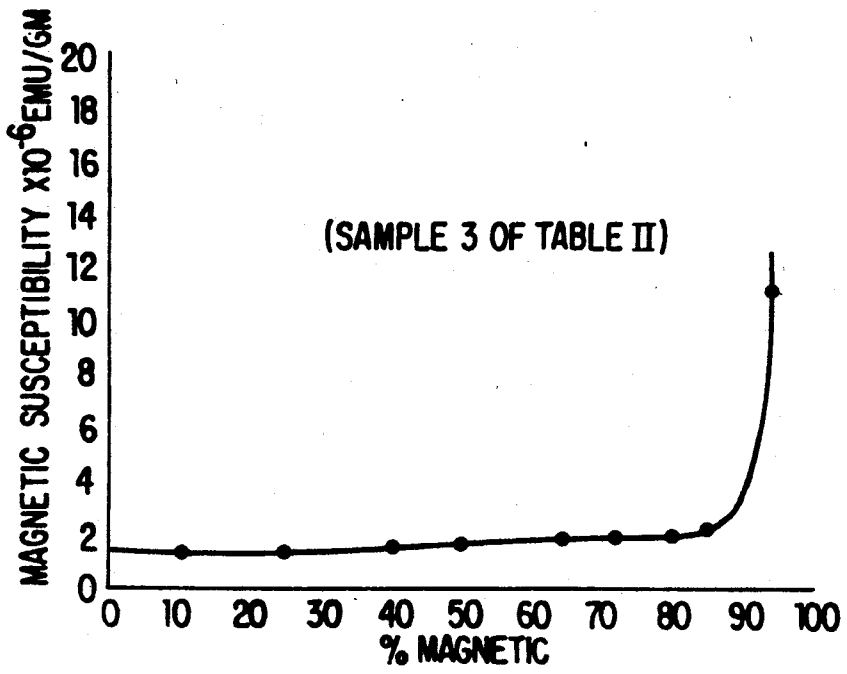
Figure 7B:
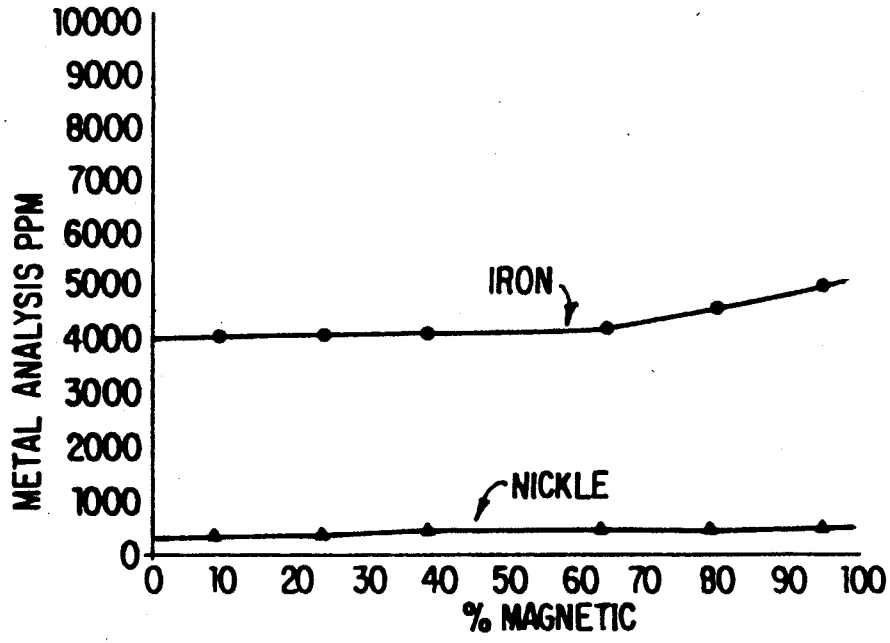

FIG. 7A is a plot of magnetic susceptibility ($10^{-6}$ emu/gm) versus percent magnetic for sample 3 of Table III.

Figure 8B:
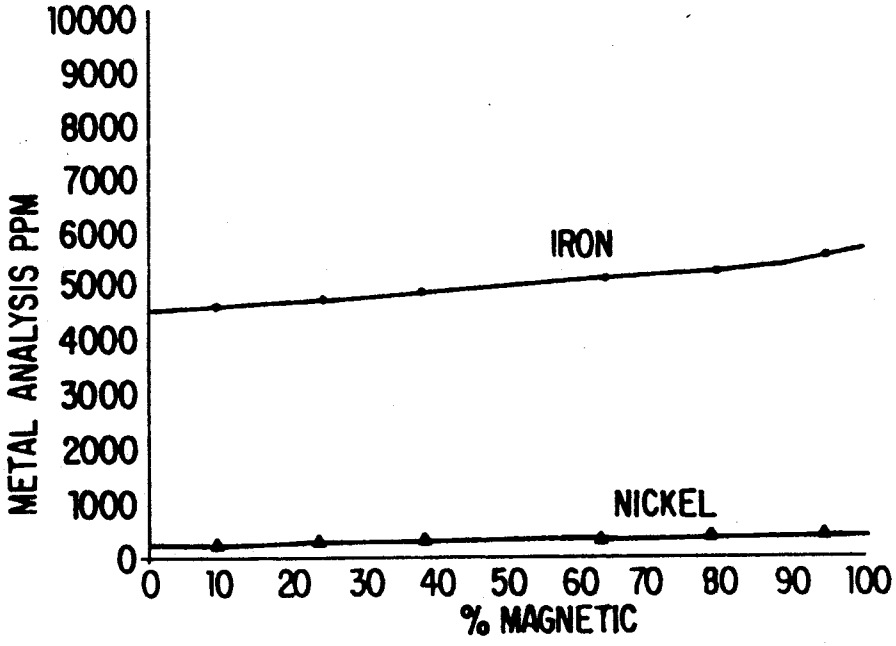
Figure 8A:
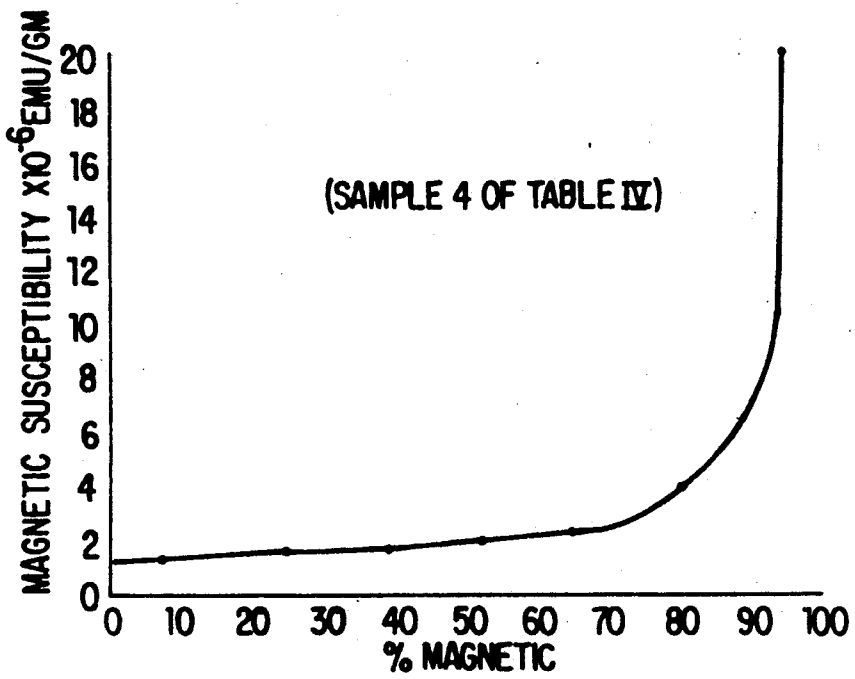

FIG. 8A is a plot of magnetic susceptibility ($10^{-6}$ emu/gm) versus percent magnetic for sample 4 of Table V.

FIGS. 5B–8B are plots of metals analysis (parts per million) versus percent magnetic for the same samples in the corresponding FIGS. 5A–8A.

Figure 9:
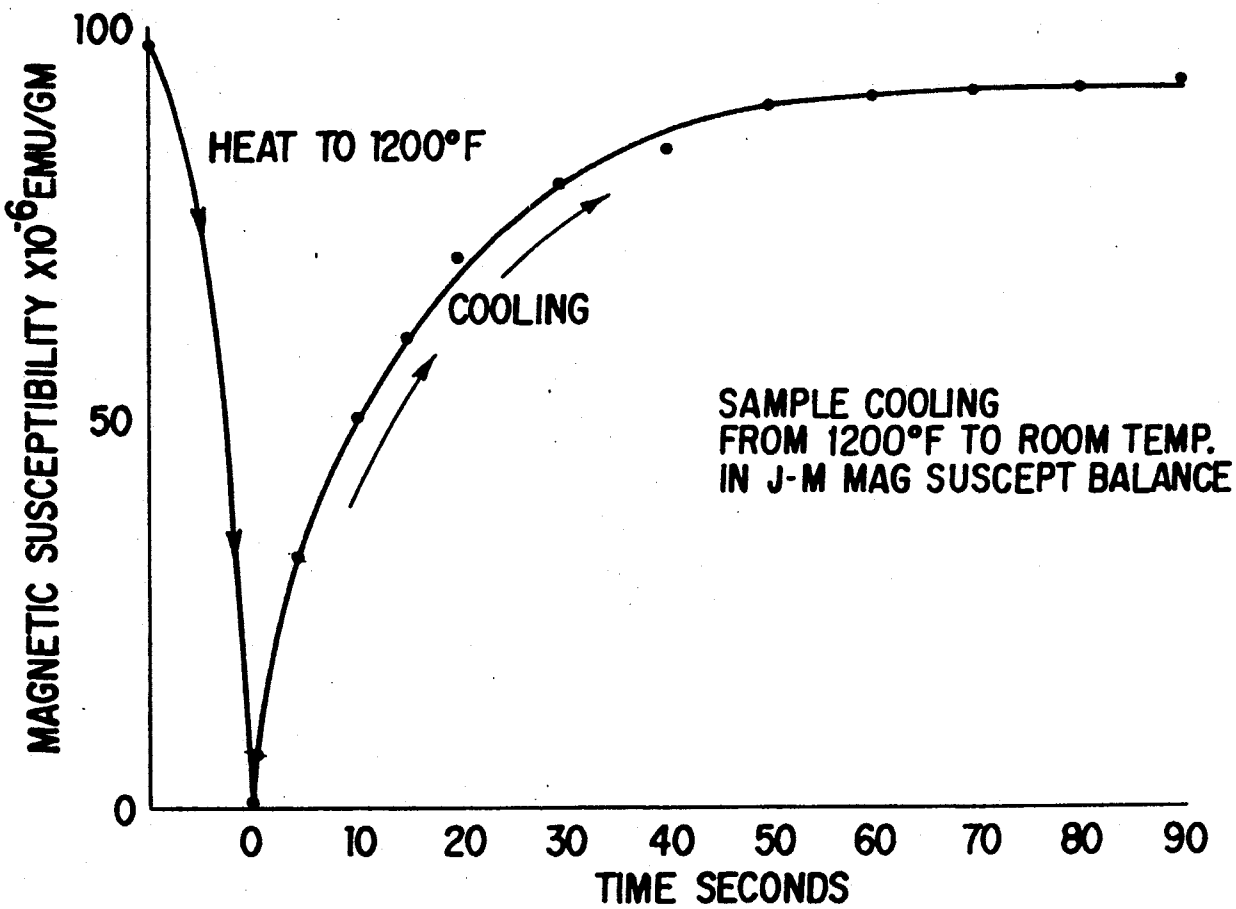

FIG. 9 is a plot of magnetic susceptibility ($10^{-6}$ emu/gm) versus time in seconds for a sample which is originally heated to 1200° F., then permitted to cool to room temperature in a Johnson-Mathey magnetic susceptibility balance.

Figure 10:
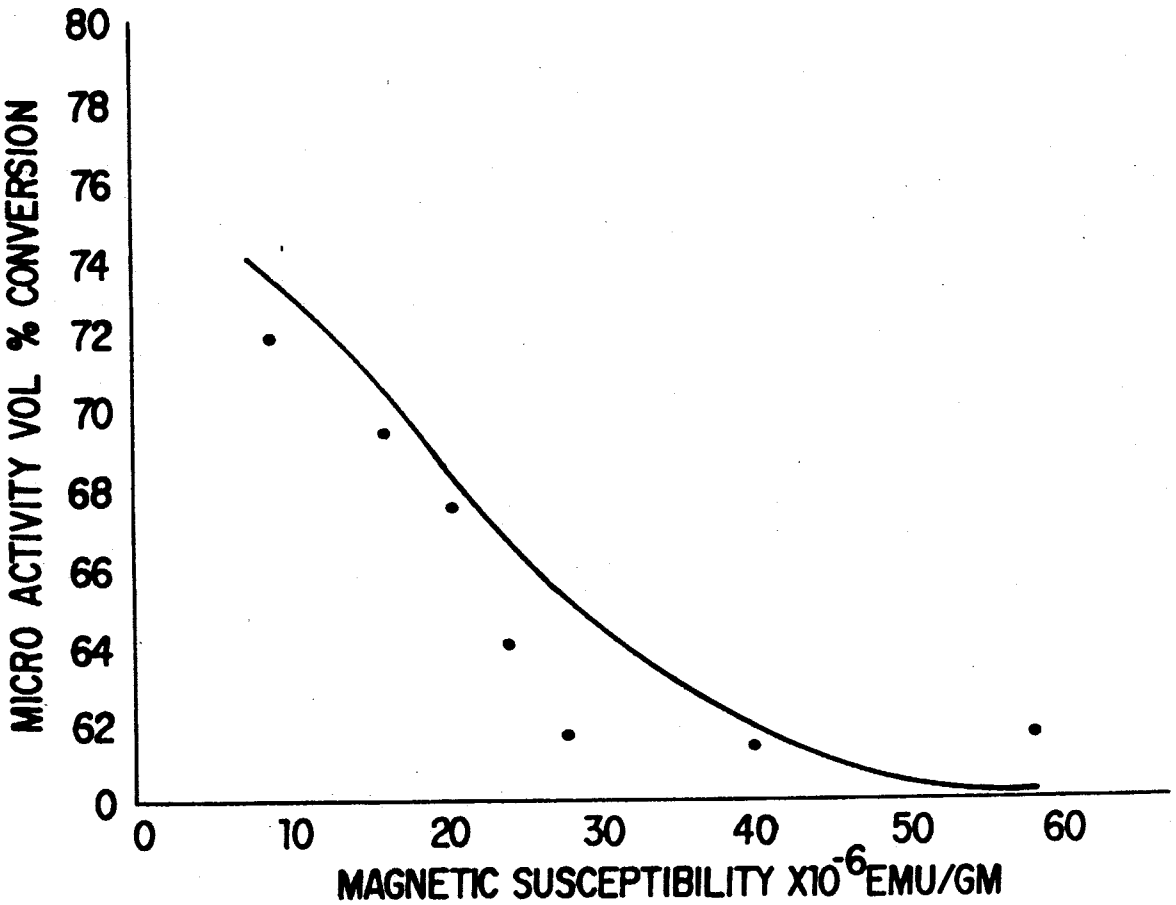

FIG. 10 is a plot of micro activity (volume percent conversion) versus magnetic susceptibility ($10^{-6}$ emu/gm) for the catalyst sample 1 of Table III (also shown in FIGS. 5A and 5B).

FIG. 11 is a schematic diagram of a conventional fluid catalytic cracking unit with a rare earth roller-belt magnetic separation unit operating on a side stream of catalyst taken off as the catalyst returns from the regenerator to the riser-reaction, with the least magnetic fraction of the catalyst being recycled back to the regenerator for reuse.

DESCRIPTION OF THE PREFERRED EMBODIMENTS

II. Utility of the Invention

EXAMPLE 1 (Best Mode)

FIG. 11 shows a preferred process employing this invention. Bottoms derived from distilling off a portion of crude oil 10 enter the conventional riser reactor at 11. In the riser the reduced crude contacts regenerated catalyst returning from the regenerator line 15 and travels up the riser 16, cracking the reduced crude and generating product 18 and spent catalyst 17 which is contaminated with coke and metals from the reduced crude. The spent catalyst 17 enters the regenerator 20 via line 19 and is oxidized with air 21 to burn off coke and thereby regenerate the catalyst for return to the riser 16. About 8% of the regenerated catalyst is diverted through line 24 through catalyst cooler 25 (optional) to magnetic separator 26, where it is spread onto belt 27, moves past roller 28, (a high intensity rare earth-containing permanent magnetic roller) which splits the catalyst into two (or more) portions 29 to 32. The more magnetic (more metal-contaminated) portions, e.g. 29, and/or 30, are rejected for chemical reclaiming, metals recovery, further magnetic separation, or disposal. The less magnetic (less metal-contaminated) portions 31 and/or 31 and 32 are recycled through line 33 back to the regenerator 20.

Following is an example of a typical catalytic cracking process operating commercially with a catalyst containing a high level of superparamagnetic material. (Although the mechanism of formation of this high magnetic specie is not known with certainty, it is related to operating at high regeneration temperature severity on a catalyst with a high level of iron on the catalyst and in the feedstock also.) In the following table, comparison is made between processing a commercial run on a catalyst high in superparamagnetic properties, while processing a feedstock also heavily loaded with iron and containing over 10,000 ppm of iron on the catalyst, and compared with processing a very similar feedstock, but low in iron, over the same catalyst but also with a low iron content and low superparamagnetic property. In both cases, the same virgin catalyst is used, but the low iron catalyst has a low iron content because of the low iron in the feed.

Table I shows the amount of feedstock being processed, the operating conditions, the composition, and the results of processing.

Example 2 (Comparative Paramagnetic Catalyst)

In order to make direct comparisons between paramagnetic properties of iron and nickel on these catalysts and these unusual values as reported here, the following experiments are performed: 100 grams (gram) of a low rare earth containing cracking catalyst similar to that used in our catalytic cracking units, is slurried with 150 ml. of $H_2O$. A solution of iron sulfate ($Fe_2(SO_4)_3.5H_2O$) is prepared by dissolving 4.38 gram in 50 ml. of water. This represents 1% by weight of iron to be deposited on the virgin catalyst. The iron sulfate solution is heated to boiling to assure complete solution, and then rapidly mixed with the catalyst slurry. This mixture is allowed to remain in contact for 12 hours, with intermittent shaking to insure good contact. After standing for 12 hours, the catalyst slurry is dewatered on a filter and the filter cake recovered. The filter cake is oven dried, calcined at 1200° F. for four hours and allowed to cool. A sample is taken for iron analysis, and a second sample for measurement of magnetic susceptibility.

A second sample of higher iron content containing catalyst, (targeted at 2½ times the iron concentration of the first sample) is also prepared by the same method. In a further experiment, iron oxalate. ($Fe_2(C_2O_4)_3.2H_2O$) is also used as the source of iron for preparation and examination. To confirm the potential contribution also from nickel, similar preparations are made with $NiCl_2.6H_2O$. The chemical analyses for all of these impregnation are shown in Table IIA, and the increase in metal content shown in Table IIA is used to determine the added iron or nickel. Referring to Table IIB, virgin catalyst iron and nickel content and virgin catalyst magnetic susceptibility are subtracted from total values to determine the effect of these added ions. Comparing the low increase in magnetic susceptibility of these samples which represent paramagnetic contributions of ionic iron and nickel to those found in our high magnetic susceptibility catalysts, clearly demonstrates the presence of new and unusual species. For example, from these experiments, it is shown that adding 1% of what is obviously paramagnetic iron, increases magnetic susceptibility approximately 1.5 to $2.2\times10^{-6}$ emu/grams. (for nickel 1.35 to $1.62\times10^{-6}$ emu/gram.) These experimental paramagnetic values for iron and nickel agree quite well with published values and further confirm the validity of the experiments and the measuring equipment.

Example 3 (Comparison of Used Magnetic Catalysts With Used Superparamagnetic Catalysts and With Synthetic Magnetite Loaded Catalyst)

Table III, samples 1 and 2, compare the magnetic susceptibility properties of two of these unusual equilibrium catalysts taken from two commercial operating units with two equilibrium catalysts having very low values. Comparison is also made with these samples which are synthetic blends, one with magnetite and one with iron oxide, both obtained from Aldrich Chemical Company. In this table we have chosen to report these high values of this superparamagnetic substance in terms relative to magnetite. However, because of the presence of this unusual material in small quantities and undoubtedly very small crystallites, its structure has not yet been determined as being magnetite-related. Note samples 1 and 2 have at least 6 to 9 times as much of this magnetic substance as samples 3 and 4.

To estimate and reference the percentage of superparamagnetic substance shown in Table II to be present in used catalyst, the value of observed magnetic susceptibility is divided by magnetic susceptibility of magnetite when present in 100 percent concentration. For example, in catalyst #1, the observed superparamagnetic value of $23.3\times10^{-6}$ emu/gm is divided by $28{,}800\times10^{-6}$ emu/gm, the value from 100% magnetite to give a value of 0.08% of magnetite like material in this sample.

Figure 1:
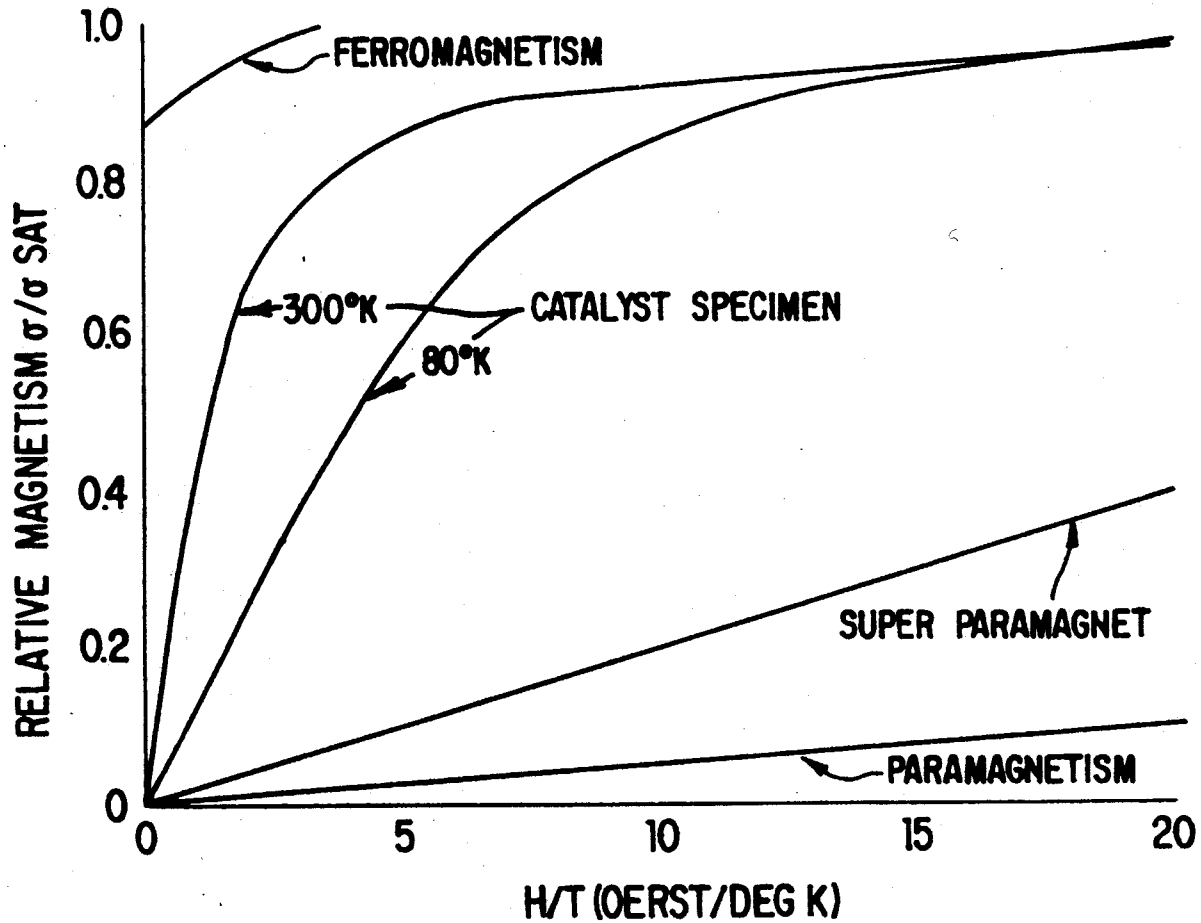
FIG. 1 shows this plot of data obtained by Professor Mulay on a sample of catalyst taken from a cracking unit operating on reduced crude, and as compared with plots of ferromagnetic, superparamagnetic and paramagnetic substances taken from page 201 of chapter 3 in "Techniques of Physical Chemistry", Vol. IIIB (1989), John Wiley & Sons, N.Y. As can be seen, the magnetic properties of this material tend to fall between the Mulay's curve for superparamagnetism and his curve for ferromagnetism, hence leading to our designation of this material based on Professor Mulay's recommendation, as a ferro/superparamagnetism substance.
Figure 2:
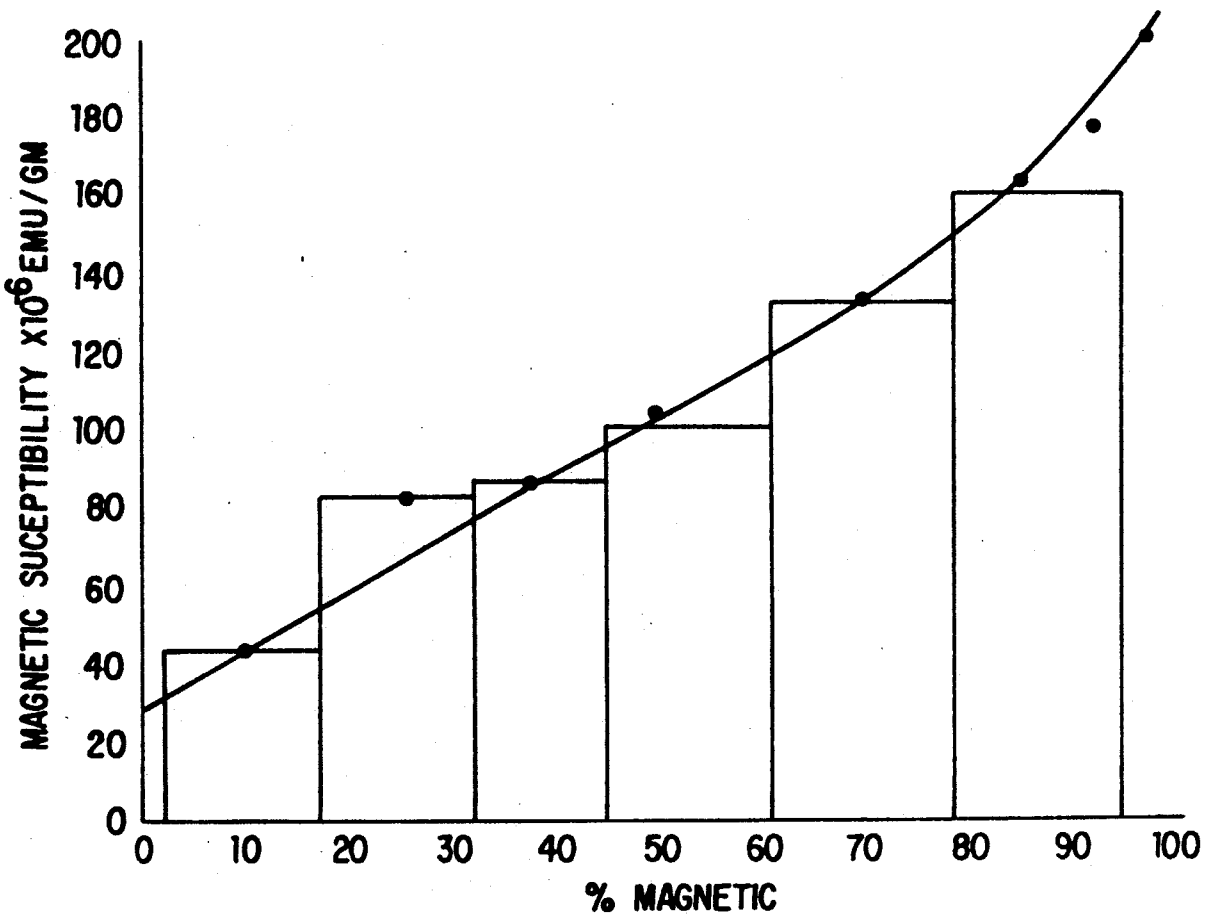
FIG. 2 is a plot of magnetic susceptibility of the various magnetic fractions taken during a magnetic separation run versus increasing magnetic properties of the above mentioned equilibrium sample obtained from a cracker. This sample has one of the highest magnetic susceptibilities yet observed and the highest magnetic fraction is even higher.
Figure 3:
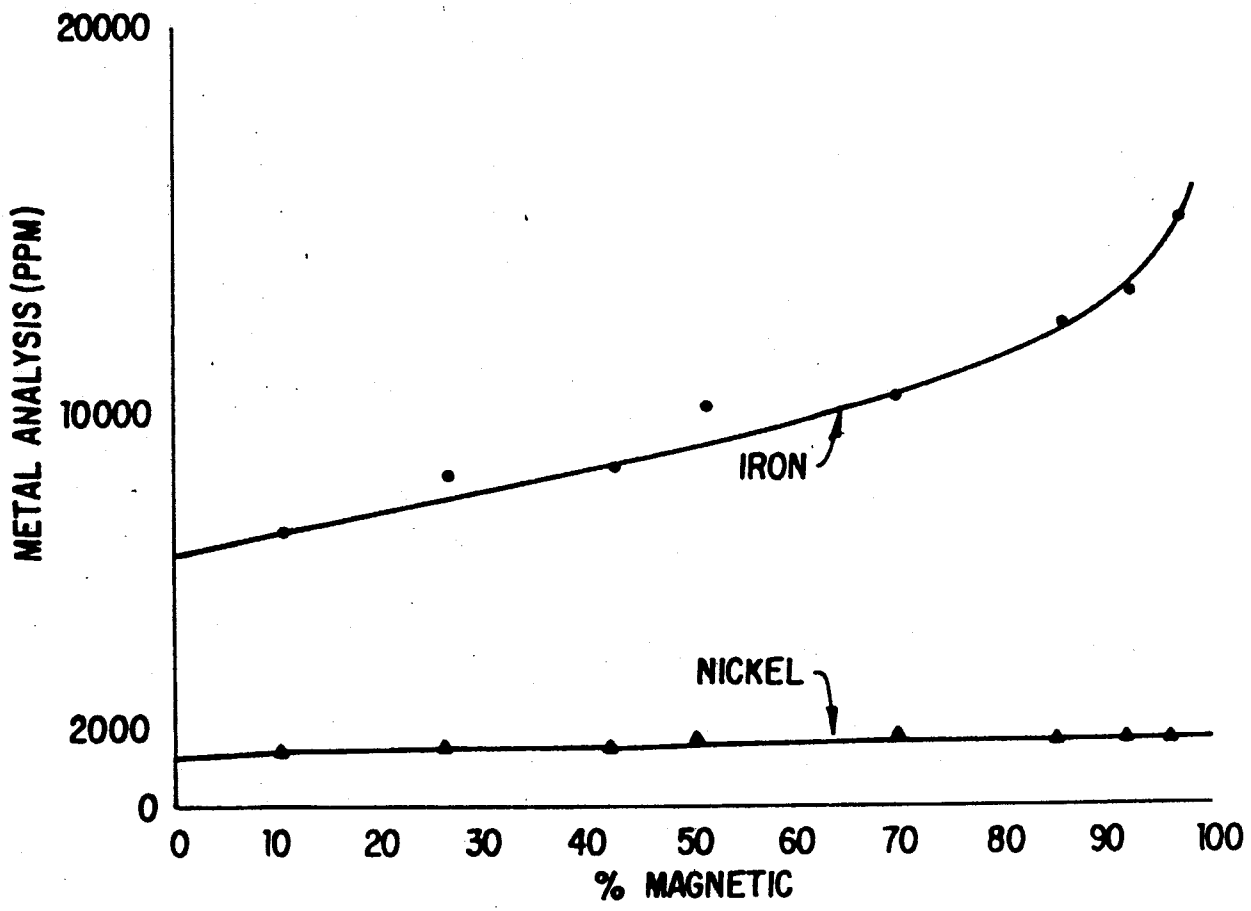
FIG. 3 is a plot of chemical analyses of nickel and iron of magnetic fractions of this sample versus magnetic properties. Iron content rises rapidly with each magnetic fraction, much more so than for nickel.
Figure 4:
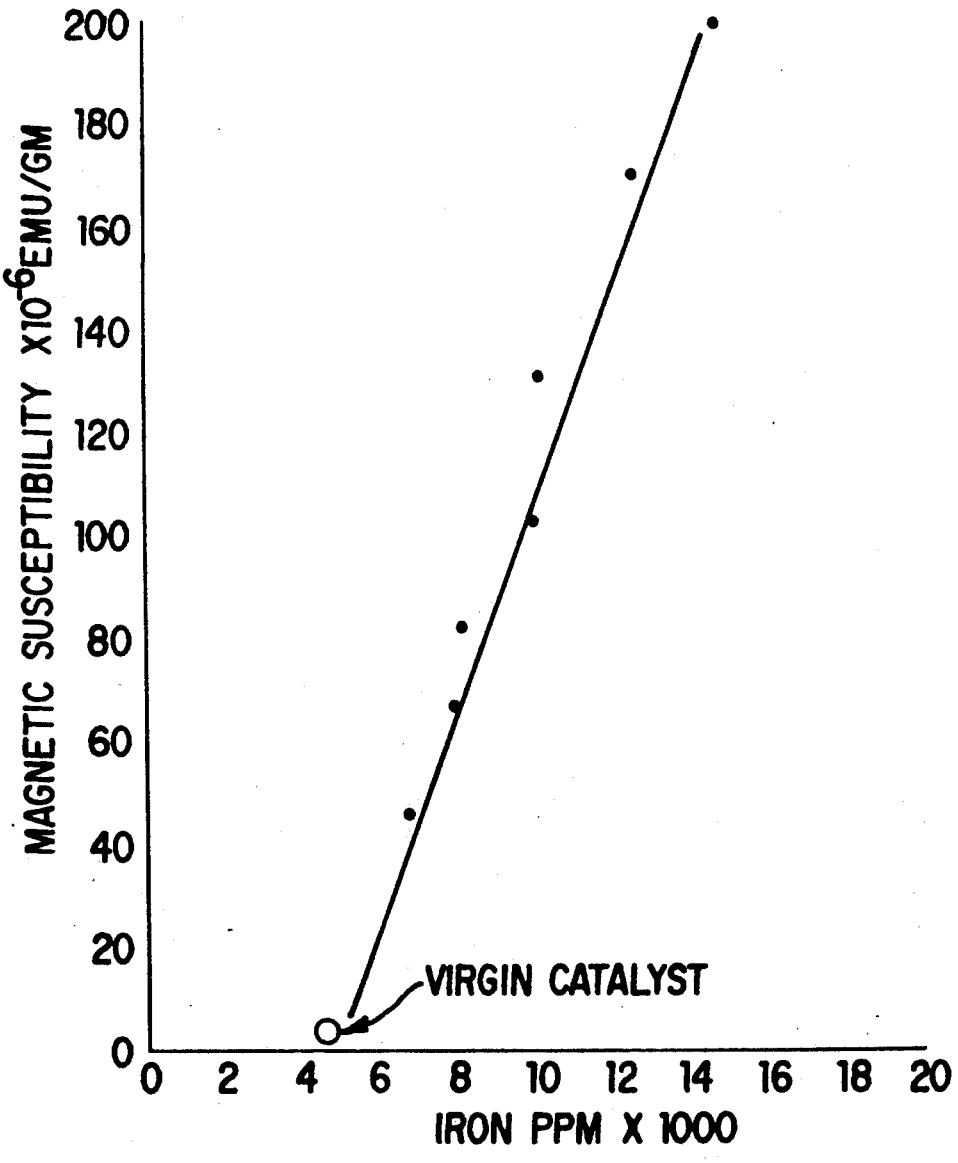
In FIG. 4, magnetic susceptibility of these fractions is plotted versus iron content.

When this superparamagnetic specie is present as shown in Table III, values of 54 to $124\times10^{-6}$ emu/gram or greater, for 1% iron are observed. This value, obviously, is many-fold greater than anticipated for paramagnetic iron (1.6 to $2.2\times10^{-6}$ emu/gram). Note also that for the iron oxide preparation at 5% level, the paramagnetic value agrees almost exactly with values observed for our impregnations. If magnetic susceptibility is plotted versus incremental iron, the presence of this highly magnetic susceptibility substance can be detected by the rate at which it changes as iron and/or nickel, or iron plus nickel changes, as shown in FIG. 4.

Consequently, it has now been discovered that when iron is present in significant amounts above that found in virgin catalyst, namely 3,000–4,000 ppm, that under certain conditions, and as iron is proportionately increased, the catalyst under certain operating conditions not yet fully identified, no longer displays the properties of a paramagnetic ion, such as highly dispersed nickel and iron.

Instead it has now been discovered that under conditions of significant iron content (in the feedstock or artificially added) in the range of 1–100 ppm concentration in feedstock accumulating on the catalyst in amounts of 500 ppm greater than on virgin catalyst iron, (and perhaps nickel) that at certain yet undefined conditions, new and much stronger magnetic properties may begin to appear.

Instead of observing magnetic susceptibilities much lower than $5\times10^{-6}$ emu's/gram (Table IIB) for a 1% normalized concentration increase of iron (or nickel, a magnetic susceptibility begins to appear, which for the total catalyst, is roughly 2–20, or even 50 times this paramagnetic value, and this level of magnetic susceptibility increase ranges from 5–50 or even up to $200\times10^{-6}$ emu's gram per of 1% iron increase on catalyst.

This superparamagnetic substance has a high Curie point (preferably greater than 500° F.).

Table III demonstrates the considerable increase in susceptibility of the entire catalyst. If these catalyst samples consisting of millions of particles 2–150 microns in diameter, are divided up into many fractions by magnetic separation by either a high gradient separation (HGMS) or a rare earth magnetic roller (RERMS) method, the high magnetic fractions will have extremely high magnetic susceptibilities of as high as $60\times10^{-6}$ emu/gram or even higher. Once catalyst sample has a magnetic susceptibility of $100\times10^{-6}$ without fractionation into cuts and a magnetic cut of one sample has a value of $284\times10^{-6}$ emu/gram.

Example 4 (Comparison of High and Low Magnetic Susceptibility of Used Equilibrium Catalyst)

FIGS. 5A, 6A, 7A, and 8A show the magnetic susceptibility of various cuts data obtained on the rare earth roller magnetic separator (RERMS) of Examples 1, 2, 3, and 4 in Table II. In FIGS. 5A and 6A, note how magnetic susceptibility rises rapidly in the higher magnetic portions of samples 1 and 2 of Table III, but FIGS. 7A and 8A show only a small tail of high value for samples 3 and 4, while most cuts stay at reported values for paramagnetic iron and nickel. A similar separation (not shown) is made on sample #1 on a high gradient magnetic separator (HGMS) and similar results were obtained showing that HGMS can also be used.

Example 5 (Relationship of High Magnetic Susceptibility and Iron Content)

When the change in iron is plotted versus percent magnetic, as shown in FIGS. 5B, 6B, 7B, and 8B for these same four catalysts, it can be seen how rapidly iron content rises, especially for samples 1 and 2. If one plots magnetic susceptibility versus iron increase, the slope rises as high as $110\times10^{-6}$ emu/gram for 1% concentration increase versus iron content for samples 1 and 2, while this increase is just barely detectable for samples 3 and 4. For these catalyst at some critical point, and extrapolating to a 100% concentration of iron, for the Canton sample, #2, it rises as much as $12,400\times10^{-6}$ emu/gram. This value is approximately ⅓ the value observed for magnetite in Table III.

While it is difficult to identify the specific magnetic specie, and we do not wish to be confined to a given specie, it is apparent that a highly magnetic specie has formed in varying amounts in all four cases, two being very large, and two being very small. FIG. 4 showed the relationship between iron content and magnetic susceptibility of a very highly magnetic specie. Here there was a rise of $200\times10^{-6}$ emu/gram for a 1% iron increase, or $20,000\times10^{-6}$ emu/gram for an extrapolation to a 100% iron specie.

Example 6 (Estimation of Curie Temperature)

To confirm that this is indeed a superparamagnetic specie which is forming, a sample, as previously described, having a very high value of $100\times10^{-6}$ emu/gram, is heated in an open flame to a temperature of about 1200° F. in a glass tube container, and then plunged into a Johnson Mathey Magnetic Balance where it is allowed to cool while its magnetic properties is measured. FIG. 9 shows the magnetic susceptibility as a function of time. At zero time, after heating, magnetic susceptibility had dropped to a value approaching a paramagnetic value. But as it cools through the Curie point, magnetic susceptibility increases rapidly and returns to the original value of the measured catalyst, thus confirming by a second means, the presence of a highly magnetic and temperature sensitive specie, superparamagnetism.

It should also be noted that superparamagnetic properties not only intensify with higher iron content, but that they also increase with time so that older particles change in properties from the paramagnetic properties possessed at low metal levels previously cited, to very high levels of magnetic susceptibility.

FIGS. 5A, 6A, 7A, and 8A, show magnetic susceptibility as a function of percent magnetic and FIGS. 5B, 6B, 7B, and 8B as a function of iron content. Removal of metal-containing catalyst is obviously facilitated by this unusual and highly magnetic property.

Example 7 (Relationship between Superparamagnetic Susceptibility and Catalyst Activity and Selectivity)

Table IV presents catalytic microactivity data obtained on magnetic fraction samples of the RCC® Process cracking catalyst (see FIGS. 5A and 5B). It will be noted that with the higher magnetic susceptibility fractions, catalyst conversion is low (61.4 vol. %) and the coke factor (2.77) and hydrogen production (0.34 wt. %) both high for the most magnetic fraction versus 71.9 vol. % conversion, coke factor of 2.30 and hydrogen production 0.24 wt. % for the least magnetic fraction #1. By the same comparison, fraction #1 has 60.9 vol. % gasoline, and has a magnetic susceptibility of $12.0\times10^{-6}$ emu/gram versus 54.59 vol. % gasoline and a magnetic susceptibility of $58.2\times10^{-6}$ emu/gram for the most magnetic. The catalyst sample as received had an overall magnetic susceptibility of $25.7\times10^{-6}$ emu/gram.

In FIG. 10, magnetic susceptibility is plotted versus vol. % catalyst conversion and shows the strong relationship between high magnetic susceptibility and low catalyst activity.

Table V summarizes the results of testing a catalyst (sample 3) that shows an overall magnetic susceptibility of only $2.6\times10^{-6}$ emu gram. The data is shown in FIG. 7A and the iron analysis in FIG. 7B. It will be noted in FIG. 7A that almost all the cut fractions have a value of less than $2\times10^{-6}$ emu/gram with only a trace of superparamagnetic material present in the most contaminated fraction. That poor separation is confirmed by Table V, which shows that there is very little change in conversion between catalyst fractions. This data shows the relationship between magnetic susceptibility and separation efficiency. The importance of superparamagnetic properties to enhance separation is clearly shown by contrast for these two samples used by comparing the data in Table IV vs. V.

TABLE I

| | High Super Paramagnetic Catalyst | Low Super Paramagnetic Catalyst |
|---|---|---|
| Total charge B/D* | 36,037 | 39,965 |
| Mag Suscept. $\times 10^{-6}$ emu/gm | 108 | 20 |
| Conversion vol. % | 69.8 | 70.9 |
| Dry Gas wt. % | 3.6 | 3.9 |
| $C_3$-$C_4$ vol. % | 22.4 | 20.8 |
| $C_5$ - 430° F. vol. % | 50.8 | 52.6 |
| 430-630° F. vol. % | 18.0 | 17.9 |
| 630° F. slurry vol. % | 12.2 | 11.2 |
| Coke wt. % | 9.3 | 10.9 |
| RBC wt. % | 4.0 | 5.6 |
| Catalytic coke wt. % equals Coke wt. %-RBC wt. % | 5.3 | 5.3 |
| $H_2$ SCF/B | 105 | 103 |
| Vol. % Gain | 3.4 | 2.6 |
| UOPK | 11.8 | 11.7 |
| Gravity °API | 19.8 | 18.2 |
| Reactor Temp °F. | 971 | 976 |
| Regen Temp °F. | 1335 | 1341 |
| Cat/Oil | 8.3 | 8.6 |
| Wt. % Sulfur | 2.0 | 2.2 |
| Fe ppm on catalyst | 10,800 | 7,100 |
| Ni ppm on catalyst | 1,900 | 1,950 |
| V ppm on catalyst | 4,100 | 5,000 |
| Fresh Cat Addn #/B | 0.64 | 1.10 |
| Equil Cat Addn #/B | 0.62 | 0.39 |
| Total #/B | 1.26 | 1.49 |
| Feed Ni ppm | 8 | 6 |
| V ppm | 22 | 20 |

*Average of all data from four weeks processing

TABLE IIA

| | | Iron (or Nickel) on Catalyst | | | |
|---|---|---|---|---|---|
| Sample # | Source of Element | Targeted Nominal Concentration ppm | Actual Analysis ppm (x-ray fluorescence) | Virgin Catalyst ppm (x-ray fluorescence) | Net Increase ppm (x-ray fluorescence) |
| 1. | Iron Sulfate | 10,000 | 12,440 | 3,500 | 8,940 |
| 2. | Iron Sulfate | 25,000 | 28,387 | 3,500 | 24,887 |
| 3. | Iron Oxalate | 10,000 | 14,418 | 3,500 | 10,918 |
| 4. | Nickel Chloride | 5,000 | 4,593 | 24 | 4,569 |
| 5. | Nickel Chloride | 10,000 | 7,401 | 24 | 7,377 |

TABLE IIB

MAGNETIC SUSCEPTIBILITIES OF TABLE 1A SAMPLES) ($Xg \times 10^{-6}$ emu/gram)

| Sample # | Source of Element | Observed Xg | Observed Virgin Xy | Observed Xg Increase Due to Element | Calculated* Xg Incr. for 1% Metal Increase | Calculated Xg Incr. for 100% Metal Increase |
|---|---|---|---|---|---|---|
| 1. | Iron Sulfate | 2.35 | 0.78 | 1.57 | 1.64 | 164 |
| 2. | Iron Sulfate | 5.66 | 0.78 | 4.88 | 1.76 | 176 |
| 3. | Iron Oxalate | 3.13 | 0.78 | 2.35 | 2.15 | 215 |
| 4. | Nickel Chloride | 1.52 | 0.78 | 0.74 | 1.62 | 162 |
| 5. | Nickel Chloride | 1.78 | 0.78 | 1.00 | 1.35 | 135 |

*Based on incremental metal analysis

TABLE III

| Commercial Cracking Catalyst | Iron Analysis ppm Equil. Cat | Iron Analysis ppm Vir. Cat | Iron Incr. ppm | Nickel Analysis ppm | Est. Para-Mag Increase Table I | | Virgin Cat-alyst | | Max. Para-Mag Incr. Contrib. | Actual Incr. Contrib. | Difference Superparamag. Contrib. |
|---|---|---|---|---|---|---|---|---|---|---|---|
| 1. RCC | 7,800 | 3,500 | 4,300 | 1,800 | Fe 0.8 Ni 0.3 | + | 1.0–1.3 | = | 2.4 | 25.7 | 23.3 |
| 2. FCC Canton | 6,400 | 3,500 | 2,900 | 1,100 | Fe 0.5 Ni 0.2 | + | 0.8 | = | 1.5 | 37.5 | 36.0 |
| 3. FCC Catlettsburg | 4,400 | 3,500 | 900 | 400 | Fe 0.17 Ni 0.06 | + | 1.0 | = | 1.2 | 2.6 | 1.4 |
| 4. FCC St. Paul | 5,400 | 3,500 | 1,900 | 400 | Fe 0.35 Ni 0.06 | + | 1.3 | = | 1.7 | 3.2 | 1.5 |
| 5. Virgin Catalyst + 5% $Fe_2O_3$ blend | | | 35,000 | | 6.48 | + | 1.0 | = | 7.5 | 7.3 | 0 |
| 6. Virgin Catalyst + 1% magnetite blend $Fe_3O_4$ | | | 7,300 | | 1.35 | + | 1.0 | = | 2.3 | 222 | 220 |
| 7. Virgin Catalyst + 1.5% magnetite blend | | | 10,488 | | 1.90 | + | 1.3 | = | 3.1 | 292 | 289 |
| 8. Virgin Catalyst + 1% magnetite blend + 4 hrs. 1200 F. in air | | | 7,300 | | 1.35 | + | 1.0 | = | 2.3 | 186 | 184 |

| Commercial Cracking Catalyst | Xg for 1% Fe | Xg for 1% Fe + Ni | Xg for 100% Fe | Est. % Superpara-Mag. |
|---|---|---|---|---|
| 1. RCC | 54.2 | 38 | 5,400 | 0.08% |
| 2. FCC Canton | 124.1 | 90 | 12,400 | 0.12% |
| 3. FCC Catlettsburg | 15.6 | 10.8 | 1,008 | 0.005% |
| 4. FCC St. Paul | 7.9 | 6.5 | 650 | 0.005% |
| 5. Virgin Catalyst + 5% $Fe_2O_3$ blend | 1.85 | 1.85 | 185 | 0% |
| 6. Virgin Catalyst + 1% magnetite blend $Fe_3O_4$ | 301 | | 30,100 | 100% |
| 7. Virgin Catalyst + 1.5% magnetite blend | 276 | avg. | 27,600 / 28,800 | 100% |
| 8. Virgin Catalyst + 1% magnetite blend + 4 hrs. 1200 F. in air | 252 | | 25,200 | 88% |

TABLE IV

MAT Results on RCC Magnetic Separation Fractions
1/15/90 RCC Equilibrium Sample - OSNA Separation
(Magnetic Off First)

| Fraction | Calc. Feed | 1st N Mag | 2nd N Mag | 3rd N Mag | 4th N Mag | 5th N Mag | 6th N Mag | 6th Mag |
|---|---|---|---|---|---|---|---|---|
| Conversion, V % | 65.47 | 71.91 | 69.27 | 67.47 | 63.91 | 61.16 | 60.96 | 61.43 |

TABLE IV-continued

MAT Results on RCC Magnetic Separation Fractions
1/15/90 RCC Equilibrium Sample - OSNA Separation
(Magnetic Off First)

| Fraction | Calc. Feed | 1st N Mag | 2nd N Mag | 3rd N Mag | 4th N Mag | 5th N Mag | 6th N Mag | 6th Mag |
|---|---|---|---|---|---|---|---|---|
| Conversion, W % | 63.98 | 70.98 | 67.59 | 65.83 | 62.32 | 59.40 | 59.11 | 59.70 |
| Conv/(100-Conv) | 1.776 | 2.342 | 2.085 | 1.927 | 1.654 | 1.463 | 1.446 | 1.481 |
| Yields, W % | | | | | | | | |
| C2 & Lighter | 1.31 | 1.43 | 1.37 | 1.29 | 1.31 | 1.20 | 1.34 | 1.22 |
| Hydrogen | 0.31 | 0.24 | 0.27 | 0.29 | 0.32 | 0.32 | 0.38 | 0.34 |
| Coke | 4.57 | 5.38 | 4.86 | 4.66 | 4.50 | 4.20 | 4.20 | 4.10 |
| Total C3's | 3.36 | 4.08 | 3.77 | 3.49 | 3.28 | 2.96 | 2.92 | 2.94 |
| Propane | 0.60 | 0.99 | 0.72 | 0.60 | 0.52 | 0.45 | 0.43 | 0.42 |
| Propylene | 2.76 | 3.09 | 3.05 | 2.89 | 2.76 | 2.51 | 2.50 | 2.51 |
| Total C4's | 7.28 | 8.87 | 8.11 | 7.63 | 7.05 | 6.47 | 6.19 | 6.38 |
| IC4 | 3.07 | 4.44 | 3.67 | 3.31 | 2.79 | 2.51 | 2.15 | 2.35 |
| NC4 | 0.56 | 0.93 | 0.69 | 0.58 | 0.49 | 0.42 | 0.38 | 0.39 |
| Butenes | 3.65 | 3.50 | 3.74 | 3.75 | 3.77 | 3.54 | 3.66 | 3.65 |
| Gasoline | 47.46 | 50.31 | 49.49 | 48.76 | 46.16 | 44.56 | 44.47 | 45.06 |
| LCO 24.79 | 24.79 | 21.60 | 23.10 | 24.01 | 25.65 | 27.25 | 26.72 | 27.13 |
| CSO 11.23 | 11.23 | 8.30 | 9.30 | 10.05 | 12.03 | 13.35 | 14.16 | 13.17 |
| Gasoline, V % | 57.47 | 60.95 | 59.96 | 59.07 | 55.92 | 53.99 | 53.87 | 54.59 |
| LCO, V % | 24.60 | 20.93 | 22.64 | 23.65 | 25.45 | 27.03 | 26.51 | 26.92 |
| CSO, V % | 9.93 | 7.16 | 8.09 | 8.88 | 10.64 | 11.81 | 12.53 | 11.65 |
| Coke Factor | 2.57 | 2.30 | 2.33 | 2.42 | 2.72 | 2.87 | 2.91 | 2.77 |
| Ni, ppm | 1860 | 1100 | 1400 | 1600 | NA | 2200 | 2400 | 2490 |
| Fe, ppm | | 9160 | 7910 | 7200 | NA | 6080 | 5900 | 5700 |
| Yield, W % | 100.0 | 15.40 | 14.90 | 12.60 | 14.10 | 15.20 | 14.00 | 13.80 |
| Magnetic Susceptibility $\times 10^{-6}$ emu/gm. | 25.7 | 12.0 | 16.8 | 21.1 | 24.1 | 27.8 | 38.9 | 58.2 |

TABLE V

Catlettsburg FCC Study

| | Base Equilibr | 1st Mag | 2nd Mag | 3rd Mag | 4th Mag | 5th Mag | 6th Mag | 6th N Mag |
|---|---|---|---|---|---|---|---|---|
| FEEDSTOCK | RPS | RPS | RPS | RPS | RPS | RPS | RPS | RPS |
| CAT/OIL RATIO | 4.62 | 4.53 | 4.54 | 4.50 | 4.51 | 4.50 | 4.52 | 4.59 |
| REACTION TEMP F. | 960.00 | 960.00 | 960.00 | 960.00 | 960.00 | 960.00 | 960.00 | 960.00 |
| REACTION TIME, SECONDS | 25.00 | 25.00 | 25.00 | 25.00 | 25.00 | 25.00 | 25.00 | 25.00 |
| WHSV | 31.20 | 31.80 | 31.70 | 32.00 | 31.90 | 32.00 | 31.80 | 31.40 |
| CONVERSION, WT % | 72.54 | 73.39 | 75.07 | 70.66 | 72.56 | 73.17 | 72.43 | 73.58 |
| CONVERSION, VOL % | 74.44 | 75.28 | 77.01 | 72.52 | 74.40 | 75.02 | 74.27 | 75.47 |
| PRODUCT YIELDS, WT % ON FRESH FEED | | | | | | | | |
| C2 & LIGHTER | 1.33 | 1.24 | 1.33 | 1.22 | 1.15 | 1.26 | 1.19 | 1.24 |
| HYDROGEN | 0.08 | 0.08 | 0.08 | 0.07 | 0.07 | 0.08 | 0.07 | 0.07 |
| METHANE | 0.41 | 0.36 | 0.38 | 0.37 | 0.32 | 0.37 | 0.35 | 0.36 |
| ETHANE | 0.36 | 0.34 | 0.36 | 0.33 | 0.32 | 0.33 | 0.32 | 0.33 |
| ETHYLENE | 0.48 | 0.47 | 0.50 | 0.45 | 0.44 | 0.47 | 0.45 | 0.48 |
| CARBON | 3.91 | 4.27 | 4.08 | 4.14 | 3.86 | 4.23 | 4.26 | 4.71 |
| PRODUCT YIELDS, WT % (VOL %) ON FRESH FEED | | | | | | | | |
| TOTAL C3 | | | | | | | | |
| HYDROCARBON | 4.75 | 4.59 | 4.93 | 4.41 | 4.51 | 4.70 | 4.66 | 4.73 |
| PROPANE | .84 | .89 | .92 | .79 | .76 | .83 | .79 | .84 |
| PROPYLENE | 3.91 | 3.70 | 4.01 | 3.61 | 3.75 | 3.87 | 3.88 | 3.89 |
| TOTAL C4 | | | | | | | | |
| HYDROCARBON | 10.26 | 10.18 | 10.83 | 9.61 | 10.08 | 10.32 | 10.55 | 10.39 |
| I-BUTANE | 4.74 | 5.01 | 5.22 | 4.51 | 4.65 | 4.84 | 4.95 | 4.89 |
| N-BUTANE | .84 | .89 | .91 | .78 | .77 | .84 | .80 | .83 |
| TOTAL BUTENES | 4.68 | 4.29 | 4.70 | 4.32 | 4.65 | 4.65 | 4.81 | 4.66 |
| BUTENES | 1.94 | 1.71 | 1.89 | 1.78 | 1.91 | 1.92 | 2.01 | 1.93 |
| T-BUTENE-2 | 1.57 | 1.49 | 1.62 | 1.46 | 1.58 | 1.56 | 1.61 | 1.57 |
| C-BUTENE-2 | 1.17 | 1.09 | 1.19 | 1.08 | 1.17 | 1.16 | 1.19 | 1.16 |
| C5-430 F. GASOLINE | 52.29 | 53.11 | 53.90 | 51.29 | 52.96 | 62.66 | 51.76 | 52.51 |
| 430-650 F. LCGO | 20.21 | 19.69 | 18.32 | 21.15 | 20.31 | 19.77 | 20.26 | 19.50 |
| 650 F.+ DECANTED OIL | 7.24 | 6.92 | 6.61 | 8.19 | 7.12 | 7.06 | 7.31 | 6.93 |
| C3 + LIQUID RECOVERY | 94.76 | 94.49 | 94.59 | 94.64 | 94.99 | 94.51 | 94.55 | 94.05 |
| FCC GASOLINE + ALKYLATE ISO/C3 + C4) | | | | | | | | |

TABLE V-continued

| | Catlettsburg FCC Study | | | | | | | |
|---|---|---|---|---|---|---|---|---|
| | Base Equilibr | 1st Mag | 2nd Mag | 3rd Mag | 4th Mag | 5th Mag | 6th Mag | 6th N Mag |
| OLEFIN RATIO | .56 | .63 | .60 | .57 | .56 | .57 | .57 | .58 |
| COKE SELECTIVITY | 1.38 | 1.45 | 1.28 | 1.60 | 1.37 | 1.46 | 1.52 | 1.59 |
| MAG SUSPECT × $D^{-6}$ emu/gm | 2.5 | 19.2 | 1.90 | 1.62 | 1.52 | 1.46 | 1.29 | 1.27 |
| YIELD WT % | 100.0 | 13.8 | 14.0 | 15.2 | 14.1 | 12.6 | 14.9 | 16.3 |
| ppm NICKEL | | 398 | 382 | 349 | NA | 293 | 269 | 240 |
| ppm IRON | | 4900 | 4400 | 4200 | NA | 4300 | 4000 | 3900 |

MODIFICATIONS

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to documents made in the specification is intended to result in such patents or literature being expressly incorporated herein by reference including any patents or other literature references cited within such documents.

What is claimed is:

1. In a hydrocarbon conversion process for contacting hydrocarbons containing varying amounts of iron, nickel and/or vanadium with particles in a reaction zone wherein coke and metals are deposited on said particles, and wherein at least a portion of said coke is removed in a regeneration zone, the improvement comprising:

(a) operating said reaction zone at a temperature of from about 900° to about 1100° F. with a particulate contact time of from about 0.1 to 5 seconds, and operating said regeneration zone at a temperature of from about 1100° to 1450° F.;

(b) accumulating on said particles at least 4500 ppm iron compounds from said feedstock or iron compounds intentionally added to the circulating reaction-regenerator system;

(c) adjusting operating conditions so as to render at least a portion of said iron compound on said particles a superparamagnetic or ferromagnetic specie of iron compound having a Curie Point of at least about 500° F. (260° C.);

(d) magnetically separating more highly magnetic particles from less magnetic particles; and (e) recycling at least a portion of said less magnetic particles.

2. A hydrocarbon conversion process comprising contacting with circulating catalysts and magnetically separating cracking catalyst particles comprising varying amounts of iron compounds into portions of higher and lower magnetic susceptibility, wherein the range of iron content on catalyst is about 500–20,000 ppm above virgin cracking catalyst iron content, wherein one or more of the separated higher magnetic catalyst fractions contains a magnetite-like iron specie having a Curie Point of at least 500° F. (260° C.) and has a magnetic susceptibility greater than about $5\times10^{-6}$ emu per gram, as measured by a Johnson Mathey Magnetic Susceptibility Balance and is at least twice the magnetic susceptibility as measured by a Faraday balance and recycling at least a portion of said lower magnetic susceptibility fraction to said conversion process.

3. A process according to claim 1 wherein the overall magnetic susceptibility of the withdrawn equilibrium catalyst is greater than about $2.0\times10^{-6}$ emu's per gram and the magnetically separated fraction has a magnetic susceptibility greater than $5\times10^{-6}$ emu's per gram, as measured by a Johnson Mathey Magnetic Susceptibility Balance.

4. A process as described in claims 1 or 2 wherein the magnetic susceptibility of the withdrawn equilibrium catalyst is greater than $2.0\times10^{-6}$ emu's per gram and the separated fraction greater than $10\times10^{-6}$ emu's per gram, as measured by a Johnson Mathey Magnetic Susceptibility Balance, and said iron compound has a Curie Point above 850° K. (577° C.).

5. A process according to claim 3, wherein the separated catalyst fraction has a magnetic susceptibility per gram of $30\times10^{-6}$ emu's per gram, as measured by a Johnson Mathey Magnetic Susceptibility Balance.

6. A process as claimed in claims 1, 2, 3, 4 or 5 wherein this magnetic separation is achieved by high gradient magnetic separators of cyclic or continuous operation.

7. A process as claimed in claims 1, 2, 3, 4 or 5 wherein magnetic separation is achieved by the use of a roller magnetic separator device in which the magnetic material consists of a rare earth magnet.

8. A process as claimed in claims 1, 2, 3, 4 or 5 wherein magnetic separation is achieved by the roller method wherein the roller is constructed of ferrite magnetic material.

9. A process as claimed in claims 1, 2, 3, 4 or 5 wherein a superparamagnetic specie is formed possessing a Curie point, and which said Curie point occurs above 150° F.

10. A process as claimed in claims 1, 2, 3, 4 or 5 wherein the presence of a ferro/superparamagnetic specie is observed to be forming during processing, and which specie is identified by a rise in magnetic susceptibility per 1% increase in iron greater than $5\times10^{-6}$ emu/gram, the presence of a temperature, above which temperature the metals present exhibit only paramagnetic properties.

11. A process as claimed in claims 1, 2, 3, 4 or 5 wherein a superparamagnetic specie can be identified by a rise in magnetic susceptibility per 1% increase in iron compound content of at least $10\times10^{-6}$ emu/gram of iron, as measured on a Johnson-Mathey Balance.

12. A process as claimed in claims 1, 2, 3, 4 or 5 wherein the presence of a superparamagnetic specie is observed to be forming during processing, and which specie is identified in equilibrium cracking catalyst which shows an increase in magnetic susceptibility of $50\times10^{-6}$ emu/gram of iron for an increase of 1% in iron compound content, new virgin catalyst as measured on a Johnson-Mathey Balance.

13. A process as claimed in claims 1, 2, 3, 4 or 5 wherein the presence of a superparamagnetic specie is present having a magnetic susceptibility of $100\times10^{-6}$ emu/gram of iron per 1% increase in iron compound content as measured by a Johnson Mathey Magnetic Susceptibility Balance.

14. A process as claimed in claims 1, 2, 3, 4 or 5 wherein the presence of a magnetite like specie is present in the equilibrium catalyst of least a 0.01 wt % concentration as compared with magnetite and as measured by a Johnson-Matthey Magnetic Susceptibility Balance.

15. A process as claimed in claims 1, 2, 3, 4 or 5 wherein the presence of a magnetite like specie is present in one or more magnetic fractions of an equilibrium catalyst in concentration of at least 0.05 wt % as compared with magnetite, and as measured by a Johnson-Matthey Magnetic Susceptibility Balance.

16. A hydrocarbon conversion process according to claim 2 comprising heating said catalyst to at least about 1200° F.

* * * * *

UNITED STATES PATENT AND TRADEMARK OFFICE

CERTIFICATE OF CORRECTION

PATENT NO. : 5,190,635

DATED : 03/02/93

INVENTOR(S) : William P. Hettinger

It is certified that error appears in the above-indentified patent and that said Letters Patent is hereby corrected as shown below:

Claims 6 thru 15, first line of each, after"1,2,3" delete --4--.

Signed and Sealed this

Twelfth Day of July, 1994

*Attest:*

Bruce Lehman

BRUCE LEHMAN

*Attesting Officer*

*Commissioner of Patents and Trademarks*